US006837166B1

(12) United States Patent
Roodenburg et al.

(10) Patent No.: US 6,837,166 B1
(45) Date of Patent: Jan. 4, 2005

(54) ROLLERCOASTER LAUNCH SYSTEM

(76) Inventors: Joop Roodenburg, S' Eustatiusstraat 7, 2612 HA Delft (NL); Peter De Vin, Arnoldsonstraat 55, 2286 AG Rijswijk (NL)

( * ) Notice: Subject to any disclaimer, the term of this patent is extended or adjusted under 35 U.S.C. 154(b) by 0 days.

(21) Appl. No.: 10/195,295

(22) Filed: Jul. 15, 2002

(51) Int. Cl.[7] ..... A63G 1/00; F16D 31/02
(52) U.S. Cl. ..... 104/53; 60/369
(58) Field of Search ..... 60/369, 371, 372, 60/413, 415; 104/53, 69, 86

(56) References Cited

U.S. PATENT DOCUMENTS 4,191,016 A * 3/1980 Roth et al. ..... 60/371
4,703,835 A * 11/1987 Negrutsky et al. ..... 187/274

FOREIGN PATENT DOCUMENTS

WO WO 02/14199 2/2002 ..... B66B/9/04

* cited by examiner

*Primary Examiner*—S. Joseph Morano
*Assistant Examiner*—Robert J. McCarry, Jr.
(74) *Attorney, Agent, or Firm*—Wendy Buskop; Buskop Law Group, P.C.

(57) ABSTRACT

The invention is a launching system made of a gripping conus connected to a wire that is connected to a winch system, a turning sheave, and a lifting cylinder that is affixed to a base, wherein the winch system has a motor driven hydraulic pump connected to an accumulator system connected to a hydraulic motor that drives a winch drum, and wherein an attached booster system is made of a cylinder connected to accumulator system and a set of sheaves connected to wire that is connected to a gripping conus that moves or stops a cart.

9 Claims, 14 Drawing Sheets

ROLLERCOASTER LAUNCH SYSTEM

FIELD OF THE INVENTION

The present invention relates to a rollercoaster launching system and booster system with an increased efficiency as to lower the maximum power of the launching system. The invention also relates to a method for both launching and stopping the rollercoaster carts.

BACKGROUND OF THE INVENTION

In general, rollercoasters are useful amusement park devices comprised of a car supported in a frame that causes the cart to follow a path where the rider experiences high speeds and gravitational forces due to loops, turns and drops. In conventional rollercoasters the carts are pulled to the top of a ramp to provide the carts with the energy needed to complete the ride. During the ride the carts convert the gained potential energy into kinetic energy i.e. speed. Since the potential energy is dependent on the height of the ramp a higher ramp makes a longer track or higher speeds possible. However the height of this ramp cannot be increased without considerably costs. Also constructional problems and environmental issues limit the height of this ramp. Another possibility of giving the carts enough energy to complete the ride is to accelerate the carts at the start of the ride adding directly kinetic energy to the carts. One of the advantages of this method of launching is that a ramp is not needed anymore thus making a smaller construction possible. Another advantage is that more exciting loops and turns can be incorporated into the rollercoaster because the kinetic energy that is given to the carts at the start can be larger compared to potential energy of the ramp-started rollercoaster. However accelerating the carts at the start of the ride has one strong disadvantage. The peak power of the launching system needs to be significantly higher than the average power that is needed for the rollercoaster. The needed power of the system to pull the carts to the top of the ramp can be low because the carts do not move at high speeds. In contrast to this giving the carts kinetic energy at the start demands a very high-powered launching system because the energy needs to be given to the carts in a very short time. Not only the launching system becomes expensive also the connection to the power grid becomes problematic. During the remaining part of the ride this power is not used. It has long been needed a system that can accelerate the carts at the start of the rollercoaster ride, which does not have such a high peak-power demand, is simple, not expensive, has precise control possibilities and is easy to construct and maintain.

SUMMARY OF THE INVENTION

The invention relates to a roller coaster with a launching system that connects temporarily to rollercoaster carts in order to place the carts in motion. The method for launching rollercoaster carts according to the invention comprises pressurizing at least one hydraulic accumulator in a launching system. The launching system includes a gripping conus, a connecting wire and a winch system. The winch drum in the winch system is connected to the hydraulic motor, a turning sheave, and a lifting cylinder that moves the conus to a starting position lifting the wire to the starting position. By connecting the connecting conus and receiving conus together, the hydraulic motor connected to the roller carts is energized moving at least one roller cart up to a predetermined speed using the hydraulic motor.

The invention relates to a winch system that is used to launch or emergency brake rollercoaster carts. The winch system has a hydraulic pump connected to a variable speed motor, pipes connected to the hydraulic pump, an accumulator system, and a winch drum.

The invention relates to a roller coaster booster system for launching a rollercoaster cart. The booster system contain cylinders, an accumulator system connected to the cylinders, connecting conus, two sets of sheaves, and a connecting wire that engages the sheaves and the connecting conus.

The invention is a rollercoaster made of a launching system that connects temporarily to a series of roller carts that are moving on a track.

The invention comprises several methods. The invention includes a method for launching rollercoaster carts, a method for emergency braking of rollercoaster carts, and a method for lowering the installed power of a rollercoaster launching system.

The present invention is detailed below with reference to the listed Figures.

DETAILED DESCRIPTION OF THE PREFFERED EMBODIMENTS

The invention contemplates a rollercoaster launching system.

An object of this invention is to provide a roller coaster launching system wherein the above-mentioned drawbacks are avoided at least to a considerable extent.

The basis of the launching system is formed by a secondary-controlled winch system. This means that the displacement of the hydro motor connected on one end to the winch drum is variable. The hydraulic motor is directly connected to the constant pressure circuit. The delivered torque and speed of the motor is controlled only with the variable displacement of the hydro motor. If the torque delivered by the motor is greater than the needed torque for the load, the motor hoists the load. If the torque delivered by the motor is less than the torque needed for the load, the load is lowered. To keep the load steady, the torque from the motor is kept in balance with the torque of the load. If more speed is needed the displacement will be a little bit enlarged. For less speed the displacement will be a little bit reduced. In this way precise control of the speed of the carts during the launching phase is possible. The motors can be driven by the HPU (Hydraulic Power Unit) high-pressure pump that maintains a constant pressure at the high-pressure circuit. Typically this pressure is 270 but other pressures can be used as well.

In the launch system the primary task of the high-pressure pump is to fill the accumulators in the time between two launches. For the launch itself a very high flow with a high pressure is needed for a short period. The accumulator capacity is calculated in such a way that the volume of high-pressure oil needed during the launching phase is entirely supplied by this accumulator. This system makes it possible to operate the launch system with a small power supply compared to the energy demand during the launch.

The secondary controlled winch is chosen because of the high accuracy and fast response of controlling the motors and the possibility to store energy. Responses of the system are very fast and acceleration of the hydraulic motor from zero to maximum speed can be obtained within 100 milliseconds.

Although the external power demand of the launching system is low the hydro motors driving the winch do need to provide this high power to the winch system. Large hydro motors are expensive. Therefore, a booster system can be attached to the launching system when very high launching speeds or very heavy carts are used. This booster system comprises a set of cylinders, which through sheaves and cables can exert an additional force on the carts. Compared to hydro motors hydraulic cylinders cost significantly less leading to a less expensive and simpler launching system.

The invention can now be understood with reference to the figures.

Figure 1:
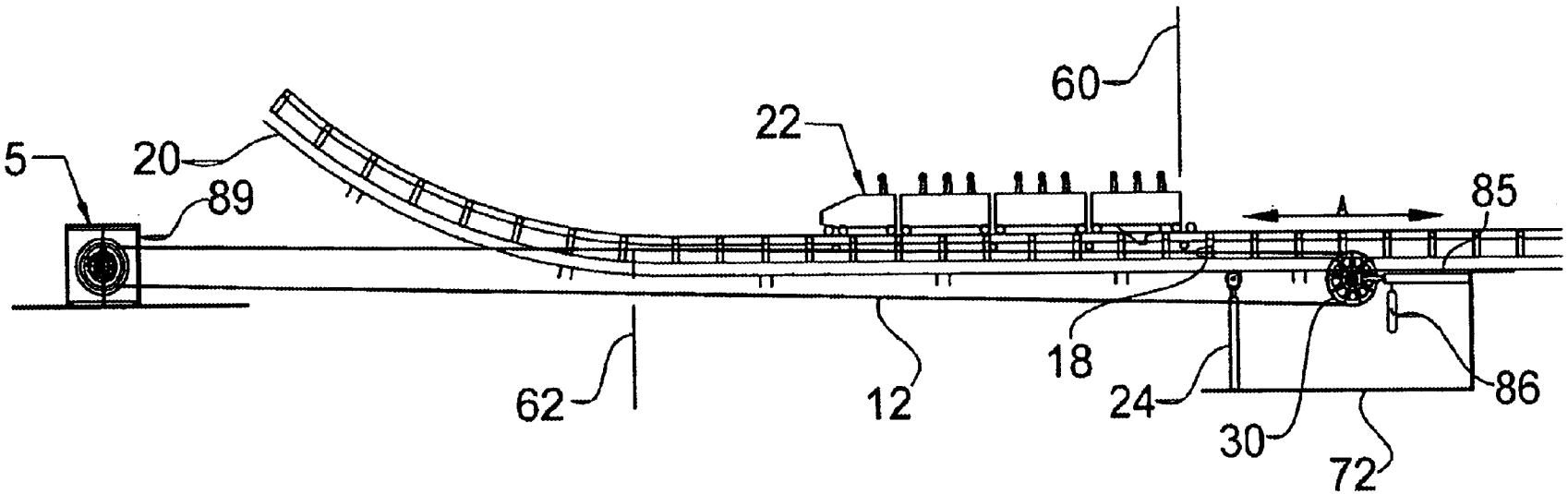
FIG. 1 is the side view of the rollercoaster launch system at the beginning of launch.

Launching system (8) is shown in FIG. 1 before launching the rollercoaster carts (22). The launching system comprises gripping conus (18) fixably connected to connecting wire (12). Gripping conus (18) can be a plate, conus, a box or any other functional geometrical shape. Connecting wire (12) is connected to winch system (5) in a standard container (89) and turning sheave (30) forming a closed loop. Connecting wire can also be in the form of a belt with teeth. Lifting cylinder (24) is removably connected to wire (12) at its upper end and fixably mounted on first base (72) at its lower end. Lifting cylinder (24) of launching system (8) lifts the connecting wire (12) in a vertical direction in order to connect the gripping conus (18) to carts (22). Constant tension on connecting wire (12) is maintained by the tensioning cylinder (85) fixably connected to turning sheave (30) at its first end and fixably connected to first base (72) at its other end. Tensioning cylinder (85) is connected to accumulator (86) in order to maintain the pressure in the cylinder at a constant value thus keeping a constant tension on connection wire (12). Turning sheave (30) of launching system (8) can move in direction A to keep a constant tension on connecting wire (12). Launching system (8) moves a series of rollercoaster camts (22) on rollercoaster tracks (20) from start position (60) to end position (62).

Figure 2:
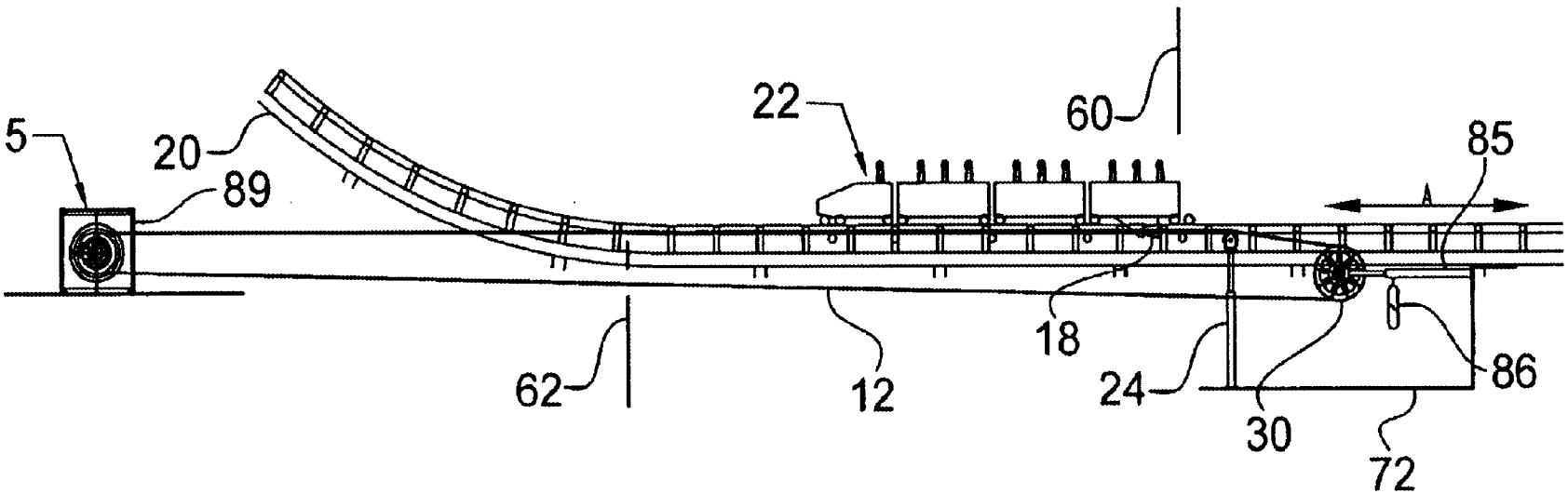
FIG. 2 is the side view of the rollercoaster launch system at the beginning of launch with the gripping conus attached to the carts.

FIG. 2 shows the elements of the rollercoaster launching system in FIG. 1 at the moment in the launching phase where gripping conus (18) removably connects to carts (22) prior to the actual launch. By lowering connection wire (12) carts (22) can move over gripping conus (18) to reach the designated launching position (60).

Figure 3:
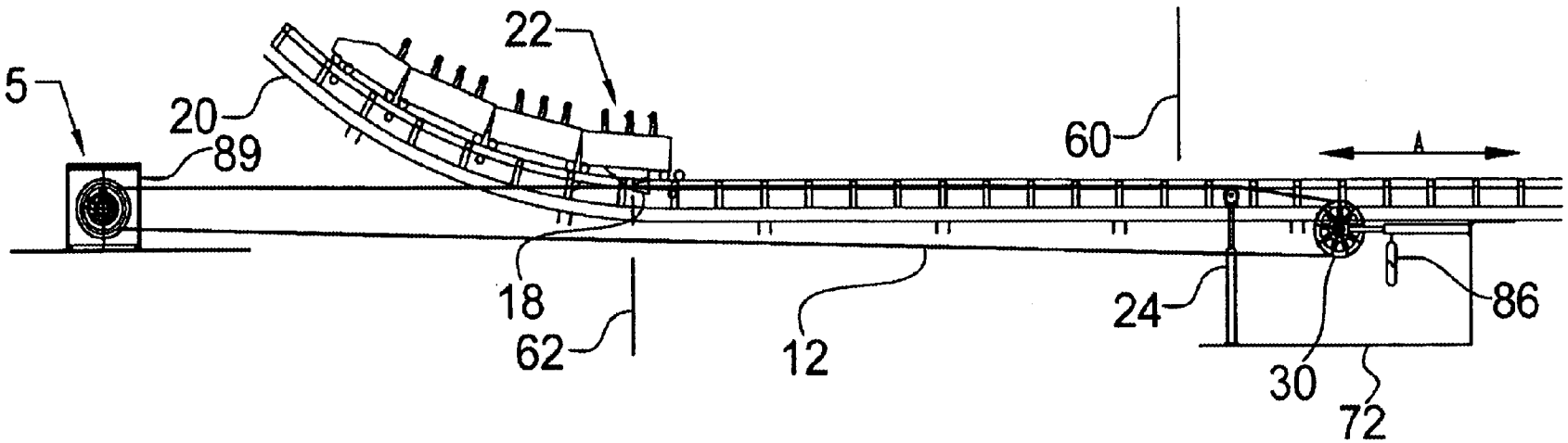
FIG. 3 is the side view of the rollercoaster launch system at the end of launch.

FIG. 3 shows the elements of the rollercoaster launching system in FIG. 1 after the launching sequence is completed and the series of rollercoaster carts (22) have passed the end position (62). After passing end position (62) the gripping conus (18) automatically unlocks and is brought back to its starting position. Another set of carts can already be standing at the starting position ready for launching.

Figure 4:
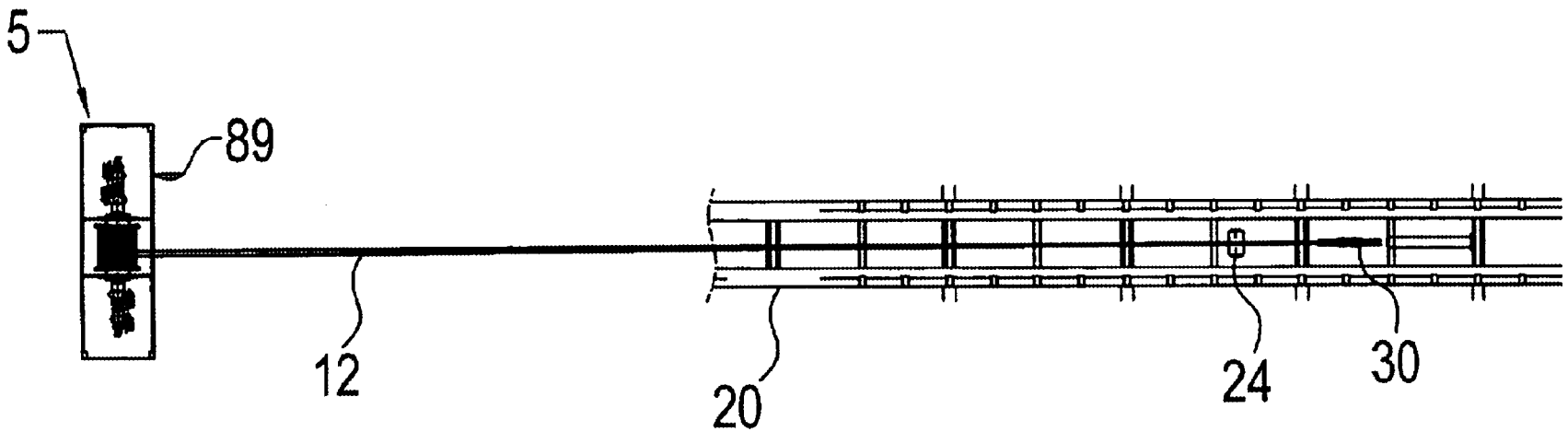
FIG. 4 is a top view of the rollercoaster launch system.

FIG. 4 is a top view of rollercoaster launching system (8). Again, FIG. 4 shows the connecting wire (12) connected to a winch system (5) in a standard container (89), turning sheave (30), and lifting cylinder (24). FIG. 4 shows the relationship of these elements to the rollercoaster track (20).

Figure 5:
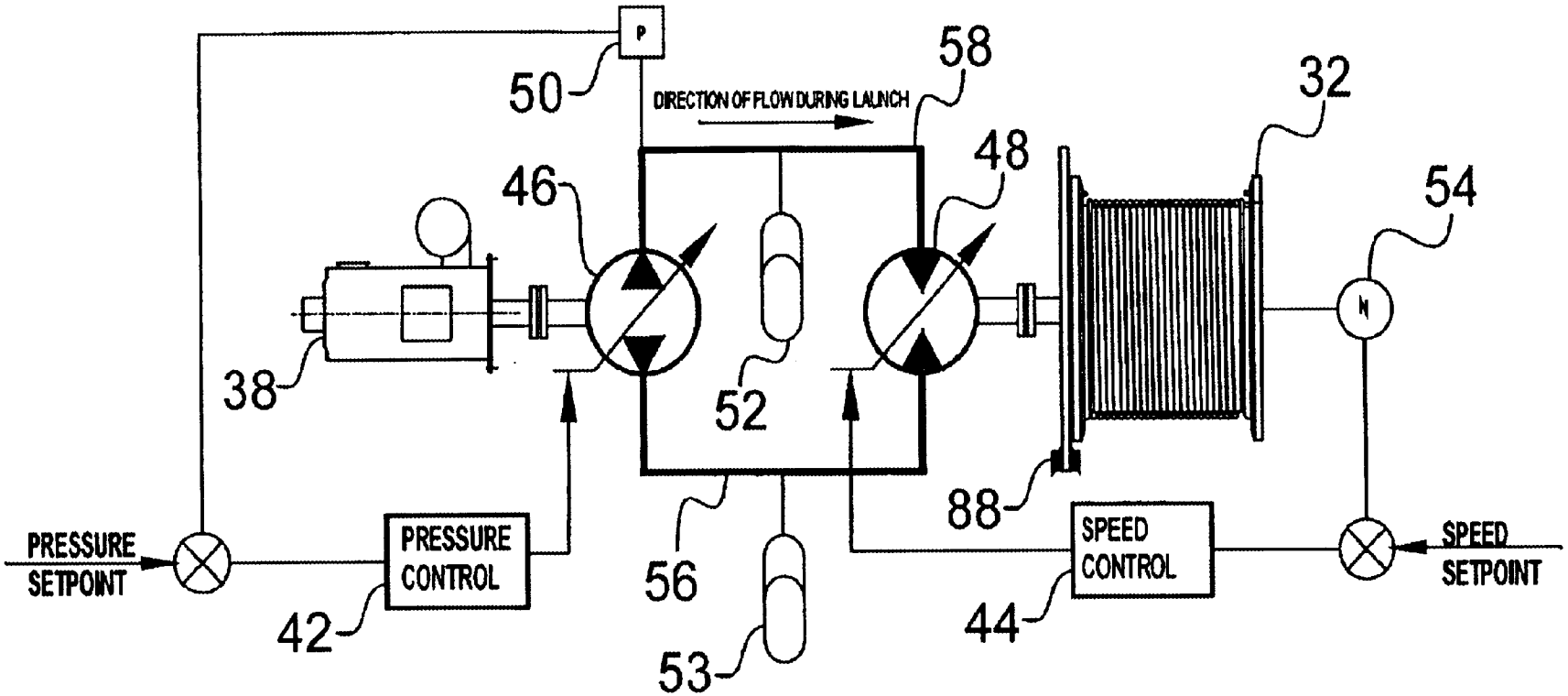
FIG. 5 is a schematic of the winch system for the rollercoaster launch system.

The secondary controlled winch system (5) shown in FIG. 1 is shown again schematically in FIG. 5. Winch system (5) comprises a hydraulic pump (46) driven by a motor (38) connected by a first pipe (56) and a second pipe (58) to an accumulator system (52) connected to a hydraulic motor (48) that drives a winch drum (32). A second accumulator system (53) can be added and connected to the second pipe (58) and the hydraulic motor (48). The winch drum is connected to the gripping conus (18) by means of connecting wire (12). The hydraulic pump in the winch system has a controllably swash plate angle. Similarly, the hydraulic motor in the winch system has a controllably swash plate angle. The speed of motor (38) and the swash plate angle of hydraulic pump (46) in the winch system can be controlled by the pressure controller (42). The pressure controller (42), in turn, can be actuated based on the signal of a pressure sensor (50). A speed controller (44) can control the swash plate angle of hydraulic motor (48). The speed controller (44), in turn, can be actuated based on a signal from a speed sensor (54). Motor (38) in the winch system can be an electrical motor or a combustion engine. An electrical motor is shown in FIG. 5. The hydraulic fluid of the winch system can be oil-based fluid, water based fluids, environmental friendly fluids, biodegradable fluids or combinations thereof. The attached winch drum (32) is connected to an independent braking system (88) to hold the winch drum if the pressure in the system drops or the hydro motor fails. The pressure in both pipe (58) and pipe (56) is preferably constant. Winch system (5) can be fixably mounted in a standard size container (89) including all controls and pressure vessels connected thereto.

The number of pumps and motors attached to winch system (5) may vary. The hydraulic pumps (46) can vary number between 1 and 10. Likewise the number of motors (48) can vary between 1 and 10. The number of hydraulic motors (48) can vary between 1 and 4 per winch drum (32). The number of winch drums (32) can vary between 1 and 6 per winch system (8).

The size of accumulators (52) and (53) is calculated to be able to store enough energy to launch a complete set of carts adding enough energy to complete the ride. The launching system stores energy between launches, which can be used during the launchings. The advantage of this system is that no large energy generators are needed anymore and a relative small launching system remains. During launching the pressure on the high-pressure side drops. The pressure drops because of the release of energy from the high-pressure accumulators. In between launches the hydraulic pump increases the high pressure to the set launching value. Since the time between launching is much longer than the launch time itself, the power of the hydraulic pump can be considerably lower than if the hydraulic pump is also the launching pump. Consequently driving motor (38) and related energy demand are very low compared to the maximum launching power.

The invention also contemplates a rollercoaster (1) with a launching system (8) that connects temporarily to a roller cart (22) that is moving on a track (20). The launching system (8) can act as an emergency brake for cart (22). It is contemplated that the number of coupled carts (22) can vary between 1 and 25. The number of launching systems (8) can vary between 1 and 4 per track (20).

Figure 6:
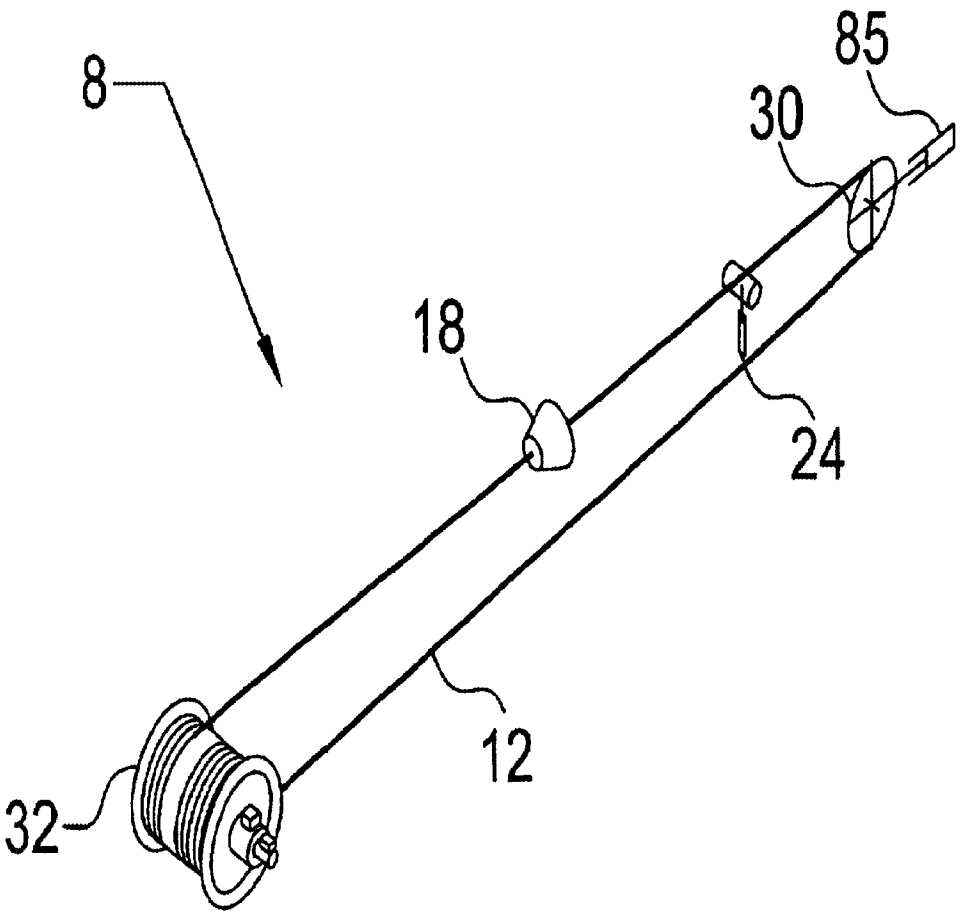
FIG. 6 is a perspective view of the launching system.

FIG. 6 shows a perspective view of launching system (8). FIG. 6 shows the launching system's (8) gripping conus (18) is fixably connected to the connecting wire (12). The figure shows the connecting wire (12) is connected to a winch system (5) and a turning sheave (30). A lifting cylinder (24) is removably connected to the wire (12) at its upper end and fixably mounted on base (72). A booster system (9) is connected to the gripping conus (18). The wire (12) is also connected to the winch drum (32). The lifting cylinder (24) can lift connecting wire (12) in a vertical direction.

Further FIG. 6 shows constant tension on the connecting wire (12) is maintained by tensioning cylinder (70) fixably connected to turning sheave (70) at its first end and fixably connected to first base (72). The tensioning cylinder (70) can be connected to an accumulator (86) (See FIG. 1, FIG. 2, and FIG. 3) to maintain pressure in the cylinder at a constant value. Also the turning sheave (30) can move in an indicated direction to keep a constant tension on connecting wire (12).

In some cases a booster system is needed to give the rollercoaster carts enough energy to complete the ride or to make certain loops and rolls possible within a given space limit. A second winch system can be installed but a winch system is expensive. A small and inexpensive booster system is contemplated with this invention. This booster system comprises two sets of sheaves and a large cylinder. When the cylinder retracts, the space between the two sets of sheaves increases and the connecting wire moves. Since the wire is connected to the rollercoaster cart the rollercoaster cart will start to move. To limit the stroke of the cylinder the wire is wound several times around the set of sheaves. Typically for each sheave in each set the stroke of the cylinder is multiplied by a factor two. When the cylinder is fully retracted after the launch of the rollercoaster cart it has to return to its starting position for launching of the next set of rollercoaster carts. Using the launching winch system does this. The booster system is designed in such a way that the force of the launching winch system is larger (during low speeds) than the force needed to extend the cylinder. In between the launches the winch system extends the booster cylinder to its starting position. To keep a constant pressure on one side of the cylinder this side is connected to a set of accumulators, which contain a gas. This gas is preferably nitrogen or another inert gas. During launching the pressure will drop in the accumulators. The accumulators serve as storage of energy that can be used during the launching phase. During the extension of the cylinder the gas is flowing into the accumulator system thereby increasing the pressure in the accumulators and storing energy. The position of the cylinder is such that the cylinder is only loaded with tensile forces. With this placement the size of the cylinder can be kept at a minimum value. After extension of the cylinder A-valve is closed between the accumulators and the cylinders. Due to the compressibility of the gas the cylinder can or will move a short distance until there is equilibrium between the forces on both sides of the piston and the wire tension. It is advantageous that the cylinder is able to move in extended position to keep a minimum tension on the wire. The valve can also be of three-way valve so that when the accumulators are disconnected the cylinder is, at the same time, connected to the environment so that no forces can act on the cylinder thus preventing a launch by accident.

Figure 7:
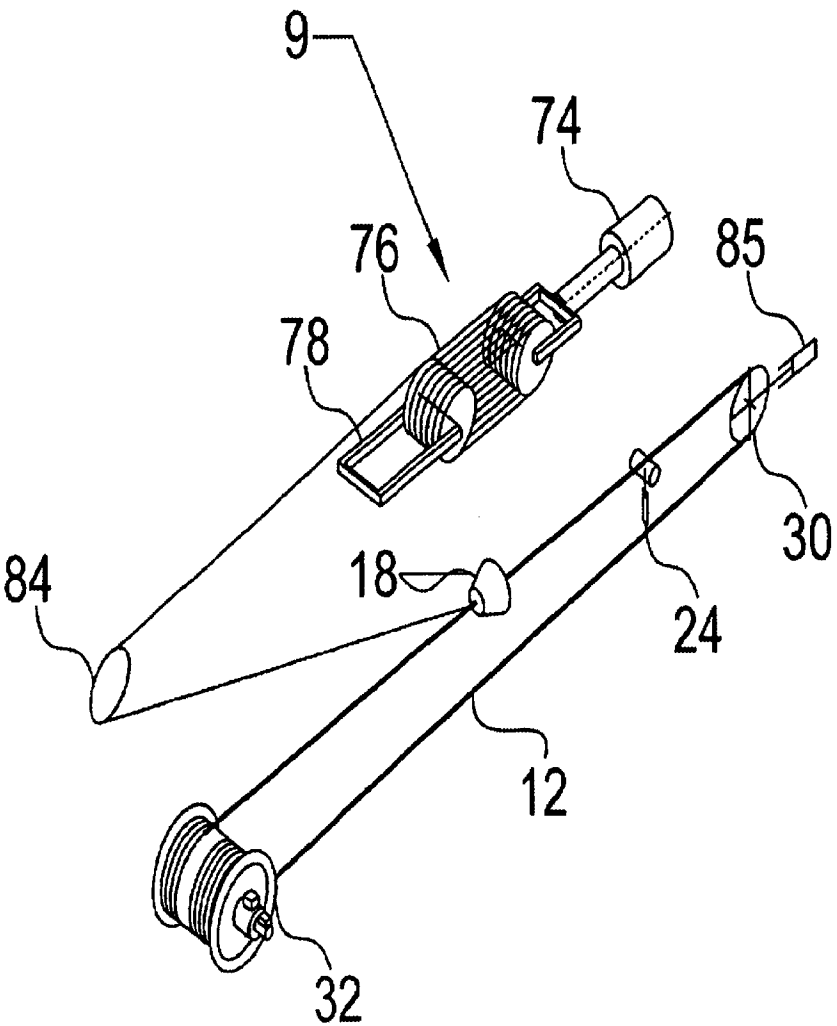
FIG. 7 is a perspective view of the launching system with an attached booster system.
Figure 8:
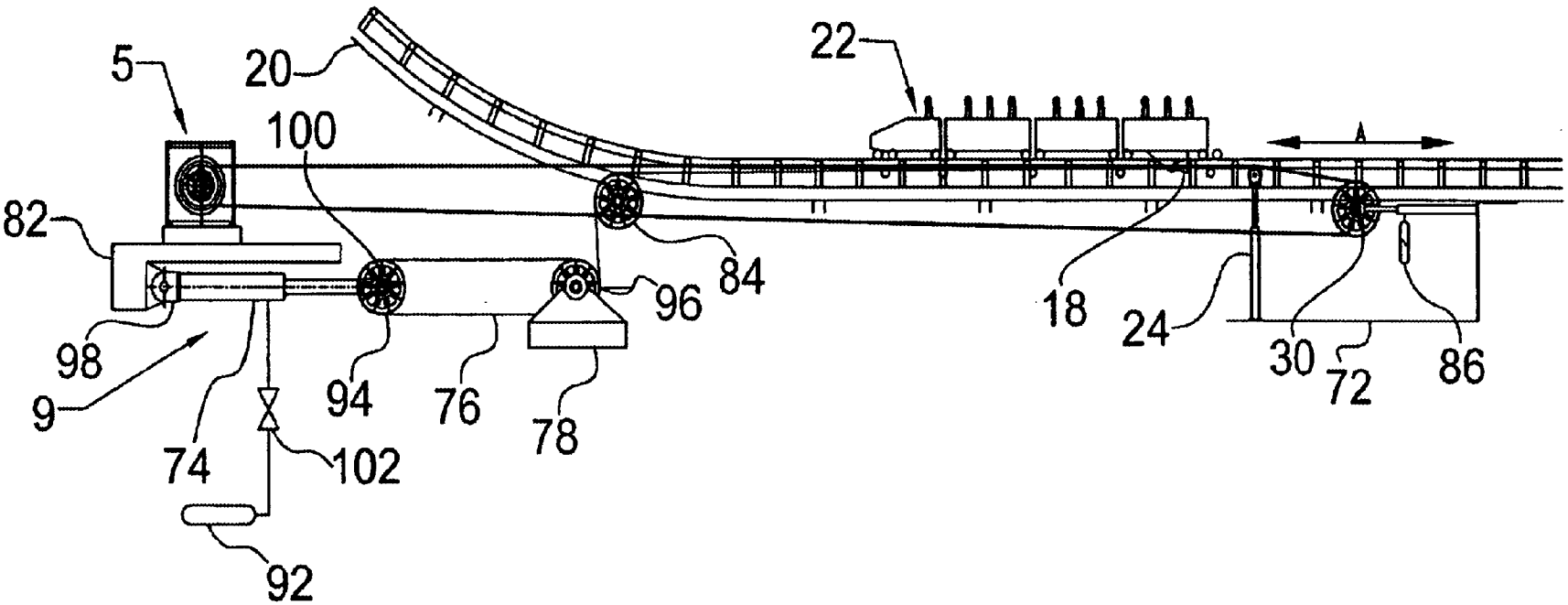
FIG. 8 is the side view of the rollercoaster with an integrated booster system.
Figure 9:
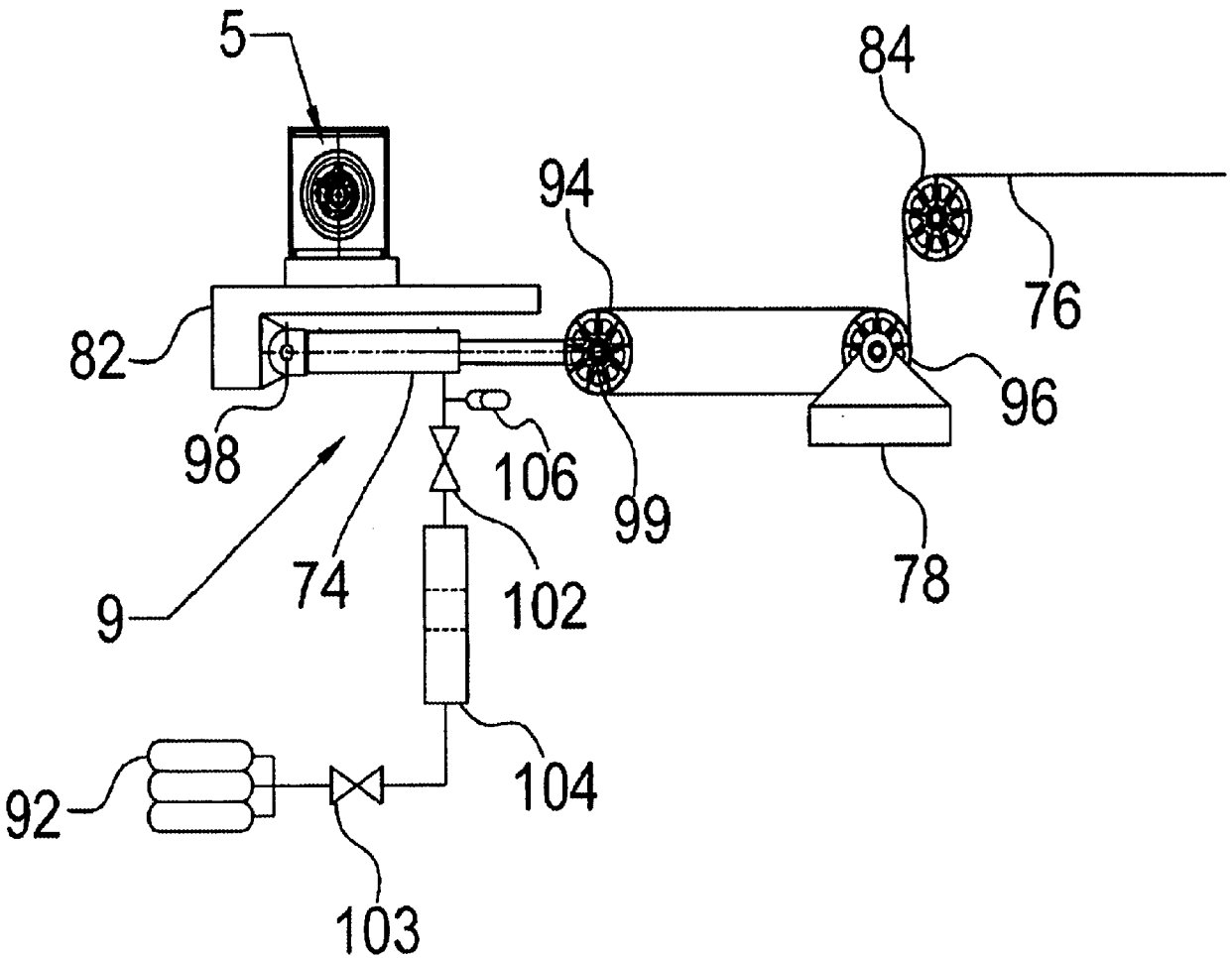
FIG. 9 is a schematic of the booster system with an attached medium separator system.

The launching can also have a booster system (9) as shown in FIG. 7 and FIG. 8. A booster system (9) may be added to the launching system and connected to the gripping or connection conus (18). As depicted in FIG. 8 and FIG. 9, the booster system has a booster system cylinder (74) connected to a booster system base (78) on a first end (98) and a rod (99) on a second end to the first set of sheaves (94). The second set of sheaves (96) is connected to booster system base (78). Wire (76) engages on one end, the connection conus (18) and on the other end the sheaves eventually rod (99). By retracting booster cylinder (74), the spooled wire length between the sheaves (94 and 96) increases and gripping on connection conus (18) will be moved to winch drum (32). Effectively, the booster system (9) will create an extra launching force on roller coaster cart (22) on the rollercoaster tracks (20). FIG. 7 also depicts the lifting cylinder (24) removably connected to connection wire (12). Constant tenision on cannecting wire (12) is maintained by the tensioning cylinder (85).

FIG. 8 shows a side view of the booster system (9) integrated into a rollercoaster launch system (8). Booster system (9) comprises a fluid filled cylinder (74) movably mounted at a first end (98) to a first base (82), which supports the winch system (5), and a second end with a rod (99) connected to a first set of sheaves (94). Cylinder (74) is also connected to accumulator system (92) via a separator (104). A wire (76) runs from a rod (99) over the first set of sheaves (94) and then over second set of sheaves (96) and is connected base (78) and on the other end to the gripping or connection conus (18). The accumulator system (92) is separated from the cylinder (74) by a closing valve (102) as well as cylinder medium separator (104). The number of sheaves in first set of sheaves (94) can vary between 1 and 10. The number of sheaves in the second set of sheaves (96) can vary between 1 and 10. The number of cylinders can vary between 1 and 5.

To keep a constant pressure on one side of cylinder (74) this side is connected to a set of accumulators (92), which contain a gas. Accumulator (92) in the booster system is filled with air, nitrogen, helium and combinations thereof. The accumulators serve as storage of energy that can be used during the launching phase. During the extension of cylinder (74) in the returning phase the gas is forced back into the accumulator system thereby increasing the pressure in the accumulators and storing energy that can be used for the next launch. The position of cylinder (74) is such that the cylinder is only loaded with tensile forces enabling the size of the cylinder to be kept at a minimum value. After extension of the cylinder to the starting position valve (102) is closed between the accumulators and the cylinders. After closing of valve (102) the cylinder can or will move a short distance due to the compressibility of the gas until there is equilibrium between the forces on both sides of the piston and the wire tension. It is advantageous that the cylinder is able to move in extended position to keep a minimum tension on the wire and to avoid slacking of the wire. Valve (102) can also be of three-way valve so that when the accumulators are disconnected, the cylinder at the same time is connected to the environment so that no forces can act on the cylinder. Thus making it impossible to launch carts by accident.

FIG. 9 shows a second embodiment of the booster system wherein the booster system comprises a cylinder medium separator (104) between accumulator (92) and cylinder (74). The medium separator fluid can be water, water based hydraulic fluid, oil-based hydraulic fluid, environmentally friendly hydraulic fluid, oil, and/or biodegradable hydraulic fluid. A closing valve can be added between the cylinder (74) and the accumulator system (92) to shut-off and separate respective parts. Also, a closing valve can be added between the cylinder medium separator (104) and the cylinder (74). Finally, a multiple connecting valve (120) can be added between the cylinder (74) and the accumulator system (92).

Also in FIG. 9, a cylinder (74) is fully retracted after launching carts (22). For a new launching procedure, cylinder (74) has to be extended to its starting position, with the rod (99) fully extended from the cylinder. In order to launch, the rod (99) is pulled into the cylinder. The force that the winch system can exert on connection wire (12) is larger than the force needed to extend the cylinder. By using winch system (5) in reverse mode the rod (99) of cylinder (74) is extended. After extension of the rod into the cylinder (74), the gripping or connecdon conus (18) is in starting position and, after increasing the pressure in the accumulators (92) to the starting value, the launching system is ready to launch another cart.

Figure 10:
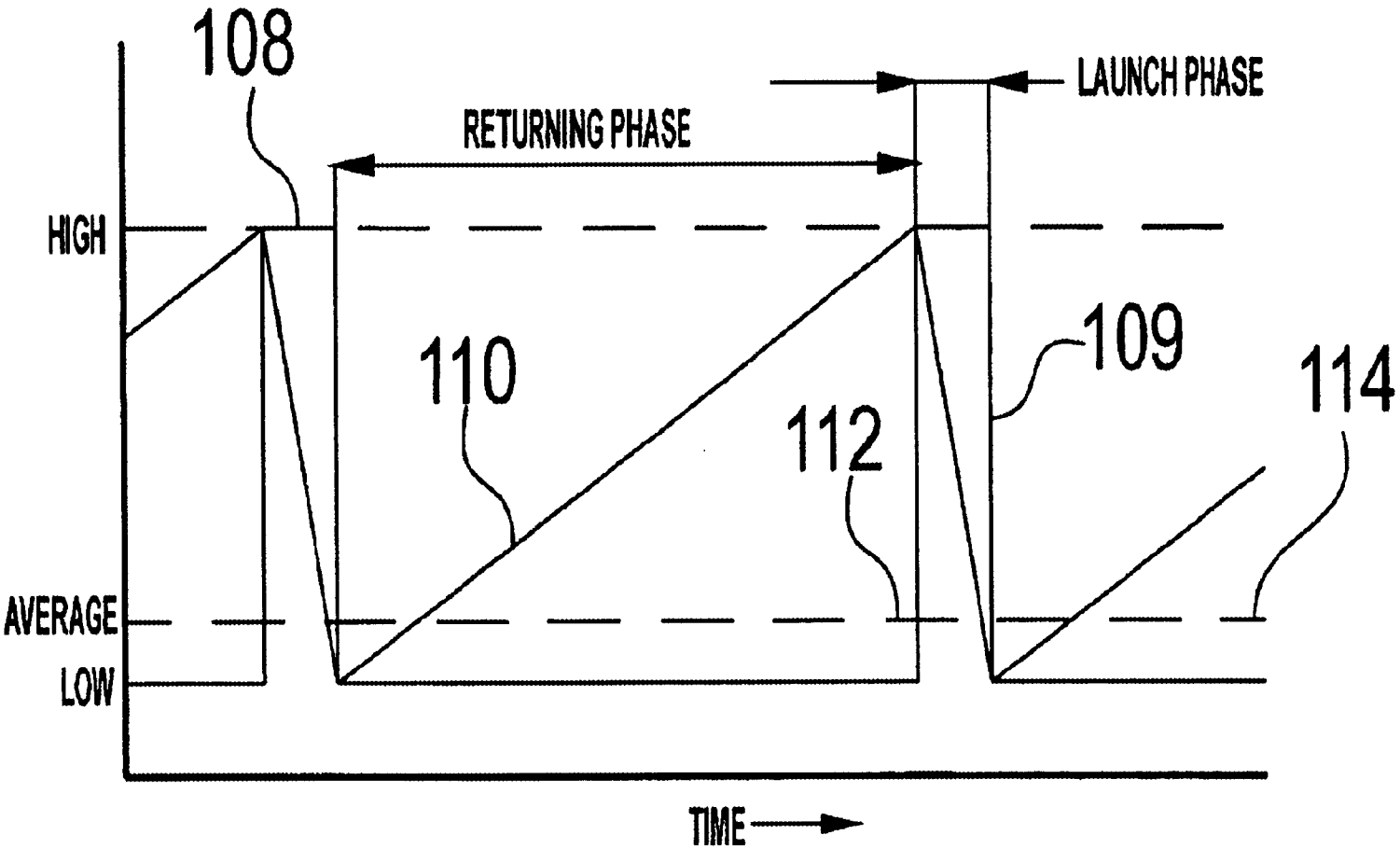
FIG. 10 is a graph showing the pressure levels associated with the rollercoaster launch system with relation to time.

FIG. 10 is a graph of the pressure (110) and power (109) levels from the start of the rollercoaster launching sequence to the returning phase in relation to time. Highlevel (108), low level (114) and average level (112) are marked on the graph as reference lines. The graph shows the pressure (110) experienced by the rollercoaster system during the start and returning sequences. During the launch phase the pressure drops in a short time to low level (114) and is increased to high level (109) in the returning phase during a much longer time. The external power demand of the winch system is the average value indicated on the figure as reference number 112. The internal power demand is indicated by reference line (109).

Figure 11:
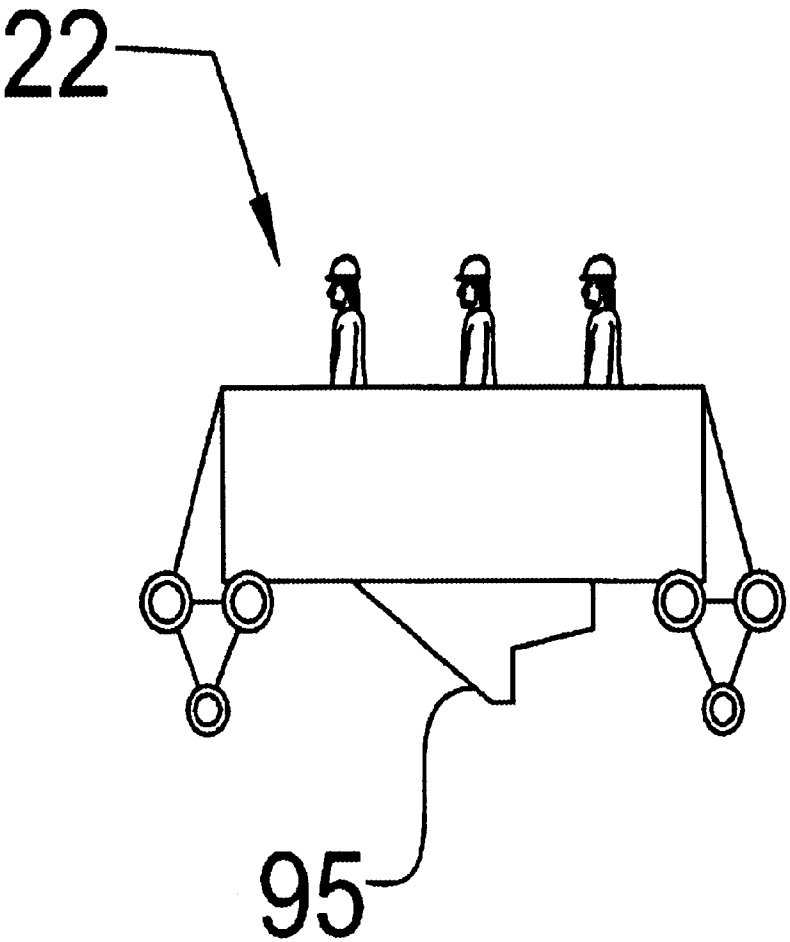
FIG. 11 is a side view of rollercoaster cart.

FIG. 11 shows the roller cart (22) for the rollercoaster launch system. In particular, FIG. 11 shows the receiving cone (95) connected to the underneath of the roller cart (22). It must be noted that the method of connecting cart (22) to connection wire (18) can be done with several other shapes and methods.

Figure 12:
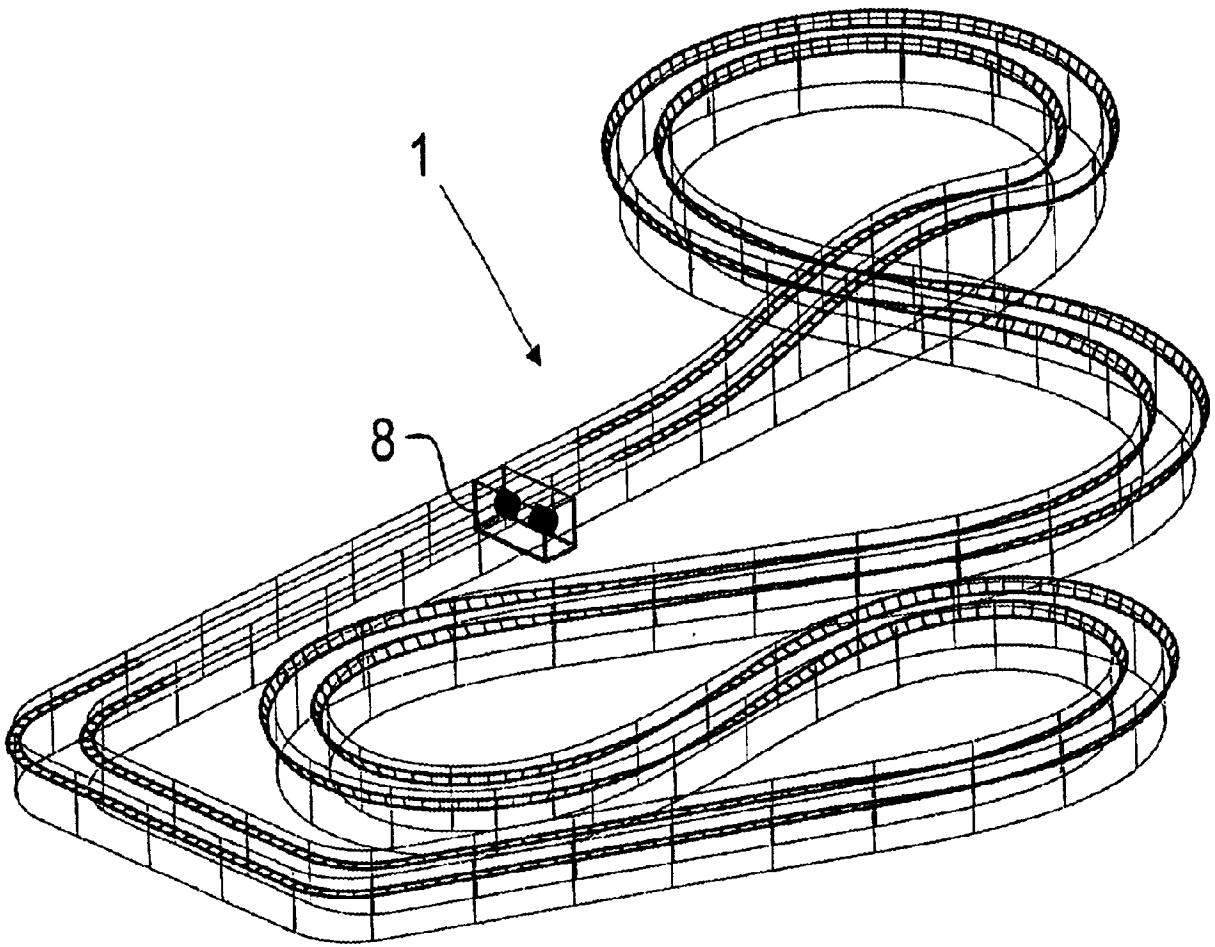
FIG. 12 is a perspective view of a rollercoaster track wherein the launching system is moving a series of carts up to a ramp.

FIG. 12 shows a perspective view of a rollercoaster (1) wherein launching system (8) is used to launch a series of carts up to a ramp. Giving the carts both kinetic and potential energy.

Figure 13:
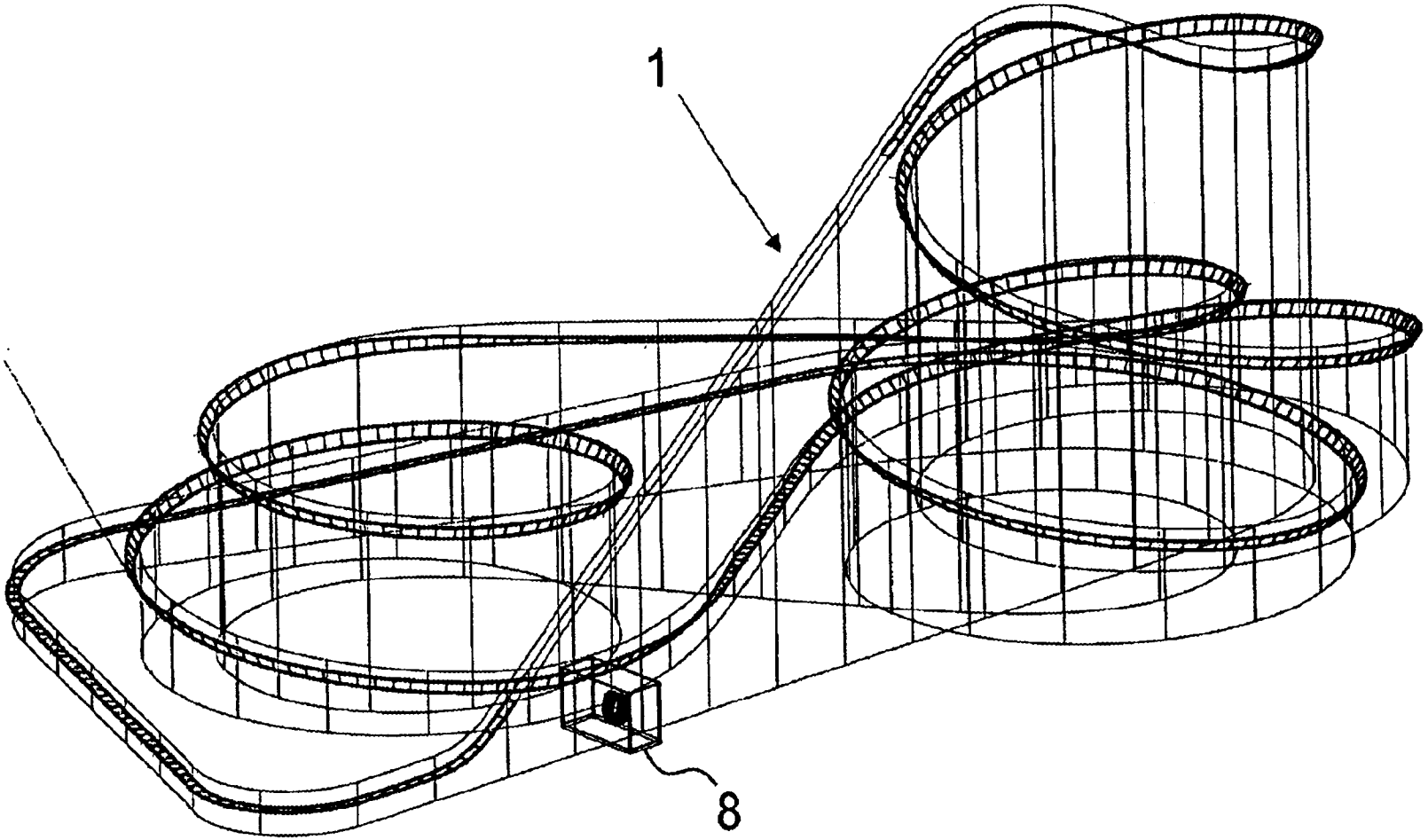
FIG. 13 is a perspective view of a rollercoaster track wherein the launching system is moving a series of cart horizontally.

FIG. 13 shows a perspective view of another embodiment of a rollercoaster (1) wherein launching system (8) launches the carts horizontally. Giving the carts only kinetic energy.

Figure 14:
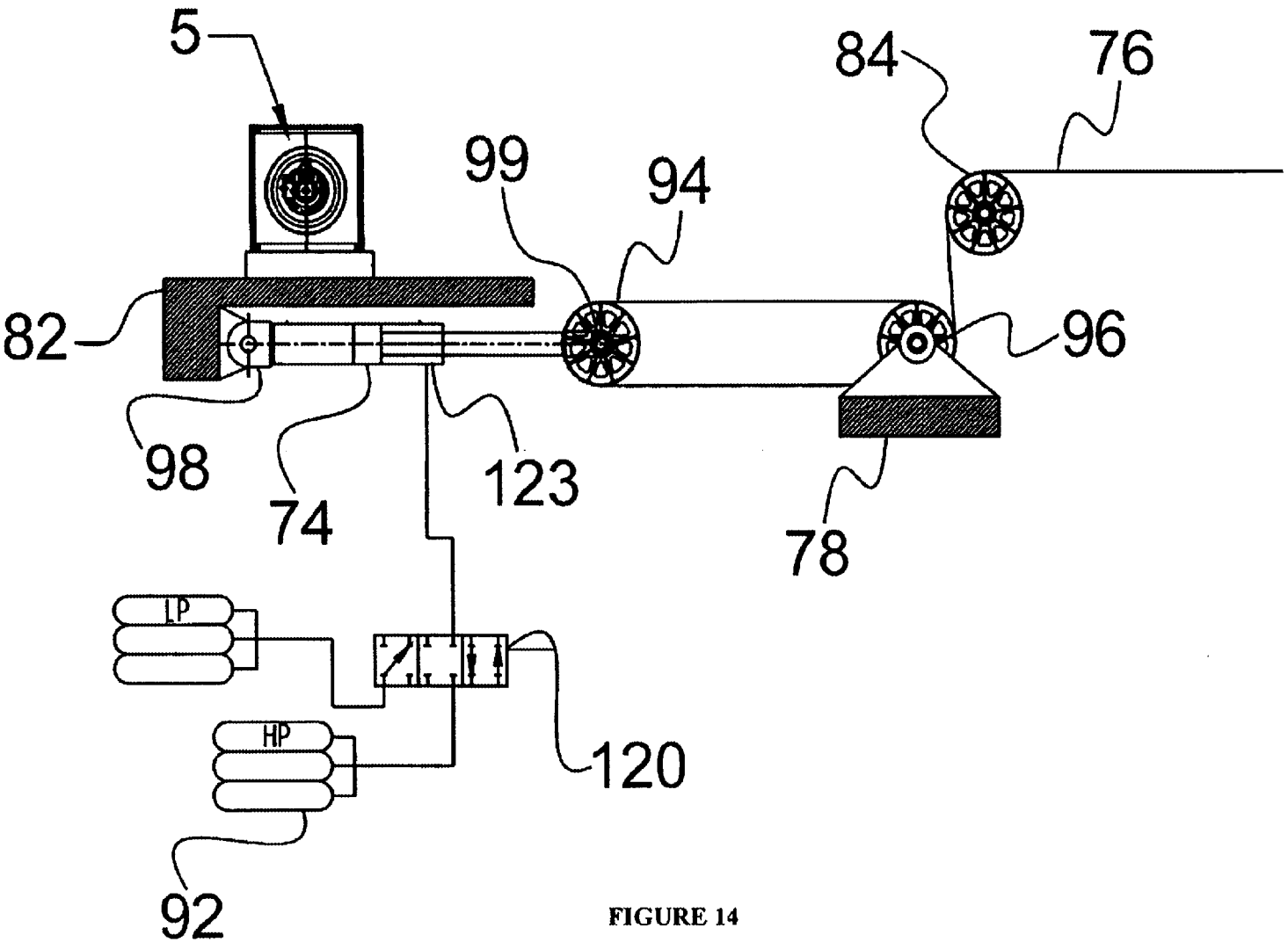
FIG. 14 is a schematic of the booster system with a load switching system.

FIG. 14 shows a third embodiment of launching system (8) with booster system (9) attached to it wherein a valve (120) is located between accumulator (92) and cylinder (74), which can connect volume (123) to the accumulator system (94) or the environment.

This invention contemplated a method for launching a set of rollercoaster carts comprising:

a. pressurizing a plurality of hydraulic accumulators in the a launching system;

b. bringing a connecting conus (18) to its starting position;

c. lifting a connecting wire at its starting position (60);

d. connecting the connecting cone (18) and a receiving cone (95);

e. energizing a hydraulic motor and speeding up a plurality of carts;

f. lowering the speed of the connection wire;

g. disconnecting the connecting conus (18) and the receiving conus (95);

h. lowering the connecting wire (12);

i. returning connection conus (18) to the starting position; and j. bringing forward another plurality of carts.

This invention also contemplates a method for emergency braking rollercoaster carts comprising:

a. lifting up connection wire;

b. bringing connecting conus (18) to ending position (60);

c. moving the connecting conus (18) to its starting position;

d. matching the speed of a plurality of carts (22) and the connecting conus (18);

e. catching the plurality of carts (22);

f. lowering the speed of the plurality of carts by using a hydraulic motor as a hydraulic pump; and g. stopping the plurality of carts A method for lowering the installed power of a rollercoaster launching system comprising:

a. using a hydraulic pump of a winch system to pressurize a plurality of high pressure accumulators;

b. using the winch system to extend a cylinder of a booster system to its starting position and to move a connecting conus to its starting position;

c. closing a valve between the booster system cylinder and the plurality of high pressure accumulators;

d. lifting a connection wire to its starting position;

e. connecting the connecting conus and a receiving box;

f. opening the valve between a booster system cylinder and the plurality of high pressure accumulators;

g. energizing a hydraulic motor and speeding up a plurality of carts;

h. lowering the speed of the connection wire;

i. disconnecting the connecting conus and the receiving box;

j. lowering the connection wire;

k. returning the connection conus; and l. bringing forward another plurality of carts.

While this invention has been described with emphasis on the preferred embodiments, it should be understood that within the scope of the appended claims, the invention might be practiced other than as specifically described herein.

What is claimed is:

1. A booster system for a rollercoaster, comprising:

a. a fluid containing cylinder having a first end with a rod slidably engaged therein;

b. a first base detachably engaging first end of the cylinder;

c. a connection wire engaging the rod;

d. a movable first set of sheaves engaging the rod on one side and the connection wire opposite the rod;

e. a second base engaging a second set of sheaves, and wherein the second set of sheaves engages the connection wire from the first set of sheaves;

f. a cylinder medium separator conneced to the rod and adapted to transfer force to the rod;

g. an accumulator system connected to the separator for storing energy; and h.

i. a connection conus connected to the connection wire from the second set of sheaves for engaging a roller coaster cart wherein the connection conus is removably attached to a cart in a rollercaster, and wherein the rod retracts into the cylinder enabling the connection conus to launch the rolletcoaster.

2. The booster system of claim 1, further comprising between 1 and 10 sheaves in the first set of sheaves.

3. The booster system of claim 1, further comprising between 1 and 10 sheaves in the second set of sheaves.

4. The booster system of claim 1, further comprising between 1 and 5 cylinders.

5. The booster system of claim 1, wherein the accumulator system comprises a gas selected from the group: air, nitrogen, helium and combinations thereof.

6. The booster system of claim 1, wherein the fluid is selected from the group: water, water-based hydraulic fluid, oil-based hydraulic fluid, environmentally friendly hydraulic fluid, oil, and biodegradable hydraulic fluids.

7. The booster system of claim 1, wherein a closing valve is present between said cylinder and the accumulator system.

8. The booster system of claim 1, wherein the closing valve is present between the cylinder medium separator and said cylinder.

9. The booster system of claim 1, wherein a multiple connecting valve is present between said cylinder and the accumulator system.

* * * * *